US006912729B2

(12) United States Patent
Nishimoto

(10) Patent No.: US 6,912,729 B2
(45) **Date of Patent: *Jul. 5, 2005**

(54) LEG GUARD

(75) Inventor: Fumitoshi Nishimoto, Sakai (JP)

(73) Assignee: Futago Shoji Co., Ltd., Osaka (JP)

( * ) Notice: Subject to any disclaimer, the term of this patent is extended or adjusted under 35 U.S.C. 154(b) by 74 days.

This patent is subject to a terminal disclaimer.

(21) Appl. No.: 10/366,527

(22) Filed: Feb. 14, 2003

(65) Prior Publication Data

US 2003/0154540 A1 Aug. 21, 2003

(30) Foreign Application Priority Data

Feb. 18, 2002 (JP) ..... 2002-039521

(51) Int. Cl.[7] ..... A41D 13/00
(52) U.S. Cl. ..... 2/22
(58) Field of Search ..... 2/22, 23, 24, 455, 2/16, 62, 269, 911; 128/878, 881, 882; 602/5, 16, 20, 23, 26, 62

(56) References Cited

U.S. PATENT DOCUMENTS

| | | | | |
|---|---|---|---|---|
| 3,125,762 A | | 3/1964 | Glahe | 2/463 |
| 3,772,704 A | * | 11/1973 | Carbonneau | 2/22 |
| 4,847,913 A | | 7/1989 | Chen | 2/463 |
| 5,301,370 A | * | 4/1994 | Henson | 2/22 |
| 5,452,475 A | * | 9/1995 | Hunt, Jr. | 2/22 |
| 5,590,826 A | | 1/1997 | Endo | 224/264 |
| 6,182,299 B1 | * | 2/2001 | Chen | 2/463 |

* cited by examiner

*Primary Examiner*—Tejash Patel
(74) *Attorney, Agent, or Firm*—Armstrong, Kratz, Quintos, Hanson & Brooks, LLP

(57) ABSTRACT

A leg guard having an instep portion to protect an instep of foot, a shin portion to protect a shin, a knee portion to protect a knee, and a sub-knee portion to protect an upper part of the knee. The leg guard is provided with a pad portion having a cover composed of thermoplastic elastomer, and the cover of the pad portion has plural convex portions protruding from the surface of the cover.

11 Claims, 18 Drawing Sheets

LEG GUARD

BACKGROUND OF THE INVENTION

1. Field of the Invention

This invention relates to a leg guard.

2. Description of the Related Art

Generally, a leg guard has an instep portion to protect an instep of a foot, a shin portion to protect a shin, a knee portion to protect a knee, and a sub-knee portion to protect an upper part of the knee. Each of the instep portion, the shin portion, the knee portion, and the sub-knee portion is composed of a protection board portion (of hard resin) and a pad portion.

And, the leg guard has plural belts to attach the leg guard on a leg by winding the belts around the leg. A buckle male member is attached to an end portion of each of the belts, and buckle female members are attached to a main body of the leg guard.

And, the conventional pad portion is made by sandwiching a board of foamed body (such as of polyethylene and polyurethane) between a cover (composed of synthetic leather, artificial leather, nylon, polyester, etc.) and a lining, and sewing.

And, conventionally, the buckle female member is attached to the main body of the leg guard through a belt-shaped attachment member, and disposed on an outer side to a border line of the pad portion (the main body of the leg guard).

However, in the conventional pad portion, variations of convex and concave configurations and patterns formed on the surface are limited. So desired complicated configurations and patterns can not be formed on the surface. And, shock absorbability against shocks by speed ball and foul tip by the foamed body is limited. Further, the cover and the foamed body may be damaged by spike shoes hitching on the leg guard and friction with the ground when sliding is blocked (as in tag).

And, in the conventional leg guard, the buckle female member may dangle and hit the leg to generate strange feeling on the leg, and may be damaged by a ball or spike shoes of a sliding runner because the buckle female member is disposed outer to the border line of the pad portion (the main body of the leg guard) when the leg guard is put on the leg. And, a hitching claw portion of the buckle male member, hitching on the buckle female member, may be damaged. Further, damage such as breaking is caused in the belt-shaped attachment member by excessive bending force when the belt is wound around the leg because the belt-shaped attachment member is attached as to be fixed to the main body of the leg guard.

It is therefore an object of the present invention to provide a leg guard, having a pad portion in which desired configurations and patterns can be formed on the surface, shock absorbability is improved, and damage on the surface is prevented, with which the damage on the buckle female member and the buckle male member can be certainly prevented.

BRIEF DESCRIPTION OF THE DRAWINGS

The present invention will be described with reference to the accompanying drawings in which.

DESCRIPTION OF THE PREFERRED EMBODIMENTS

Preferred embodiments of the present invention will now be described with reference to the accompanying drawings.

Figure 1:
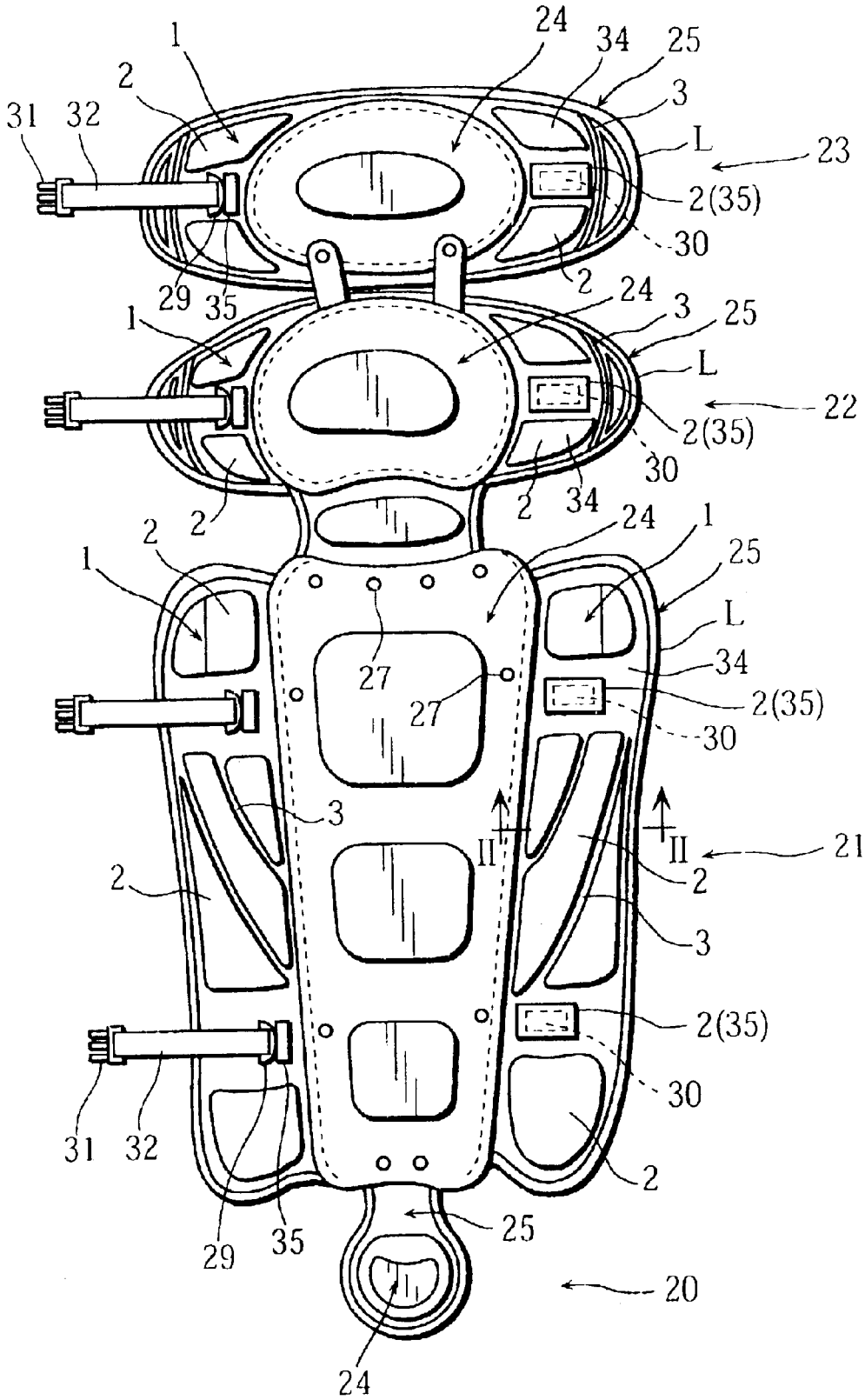
FIG. 1 is a front view showing an embodiment of the present invention.

FIG. 1 shows an embodiment of a leg guard relating to the present invention. This leg guard has an instep portion 20 to protect an instep of a foot, a shin portion 21 to protect a shin, a knee portion 22 to protect a knee, and a sub-knee portion 23 to protect an upper part of the knee. Each of the instep portion 20, the shin portion 21, the knee portion 22, and the sub-knee portion 23, is composed of a protection board portion 24 and a pad portion 25.

The leg guard is used for umpires and players of sports such as baseball and softball, and put on as to cover a front side of the leg. To describe concretely, the leg guard has plural belts 32, each of which has a buckle male member 31 on one end and a belt attachment member 29 on the other end, on one side in a longitudinal direction, and plural buckle female members 30 on the other side in the longitudinal direction. The leg guard is put on by winding the belts 32 around the leg and (detachably) hitching the buckle male members 31 on the buckle female members 30. The buckle male members 31, the buckle female members 30, and the belt attachment members 29 are composed of resin such as polyacetal.

Figure 2:
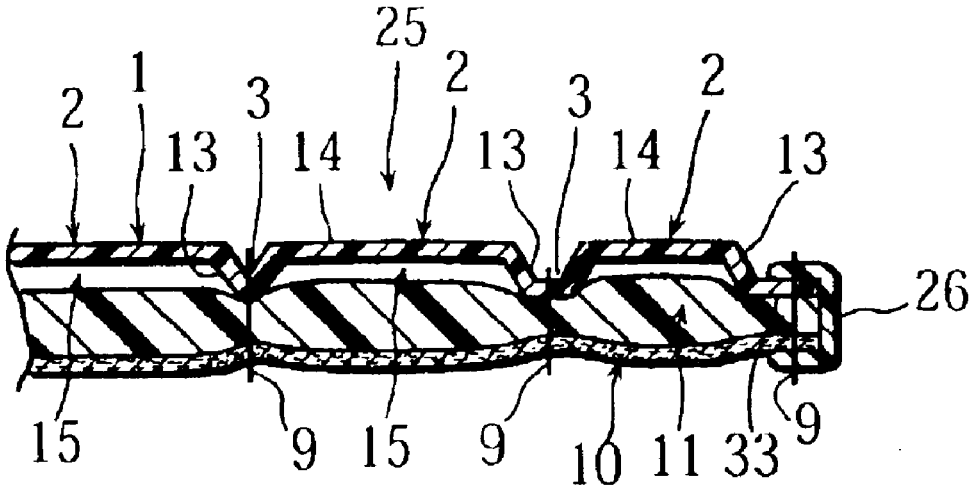
FIG. 2 is a cross-sectional view on II—II line of FIG. 1.

As shown in FIG. 1 and FIG. 2, the pad portion 25 is composed of a cover 1, a lining 10, and a board of foamed body 11 (such as polyethylene and polyurethane) sandwiched between the cover 1 and the lining 10, and the cover 1, the foamed body 11, and the lining 10 are sewn with machine sewing thread 9 and a rim-binding portion 26 to be united. The following description is for the pad 25 on the shin portion 21.

The cover 1 is composed of injection-molded thermoplastic elastomer (TPE) such as of polyurethane system, polyester system, polyethylene system, polystyrene system, etc. And, the cover 1 is, for example, composed of soft TPE of Shore D 25 to 55 having lower hardness than the protection board portion 24 of hard resin of Shore D 65 to 95.

The cover 1 has a reverse wall portion 33 and plural convex portions 2 protruding through the reverse wall portion 33 toward a face side. The convex portion 2 has a peripheral wall portion (side wall portion) 13, a surface wall portion 14, and an inner space 15 on the reverse side. The face side means a side opposite to the leg.

A groove bottom 3 between neighboring convex portions 2 connects opening ends on the reverse side of the neighboring convex portions 2 (namely, edges of the peripheral wall portions 13). The configuration of the groove bottom 3 may be a flat face of a groove formed as to have rectangular cross section, or a line corresponding to a peak of a triangular cross section.

Machine sewing thread 9, for sewing the cover 1, the foamed body 11, and the lining 10 to be united, is disposed on the groove bottom 3. The cover 1 is easily and freely bent and deformed around near the groove bottom 3 (the machine sewing thread 9), fitting feeling of the leg guard when put on the leg is improved, and sides of the leg can be certainly covered.

Figure 3:
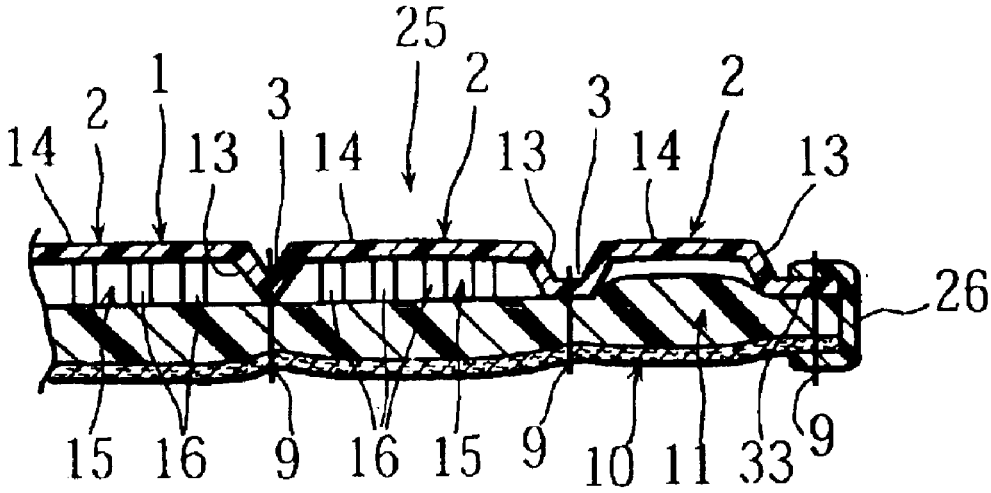
FIG. 3 is a cross-sectional view showing another embodiment of the pad portion.

In the configuration of the convex portion 2 of the cover 1, as shown in FIG. 3, plural rib portions 16 touching the foamed body 11 may be disposed in the inner space 15 of the convex portion 2 and the reverse side of the surface wall portion 14 to be strong against shock. In this case, when the inner space 15 of the convex portion 2 is composed of only an air layer as shown in FIG. 2, cushion of the convex portion 2 is soft. On the contrary, in the case shown in FIG. 3, cushion of the convex portion 2 is hard for the rib portions 16 in the inner space 15 of the convex portion 2.

Further, although not shown in Figures, a foamed block body (of polyethylene, polyurethane, ethylene-vinylacetate copolymer, etc.) may be disposed in the inner space 15 of the convex portion 2 to increase the degree of freedom of shock resistance (degree of freedom of elasticity and strength design), and thickness of the reverse wall portion 14 of the convex portion 2 may be increased to enhance the shock resistance.

Figure 4:
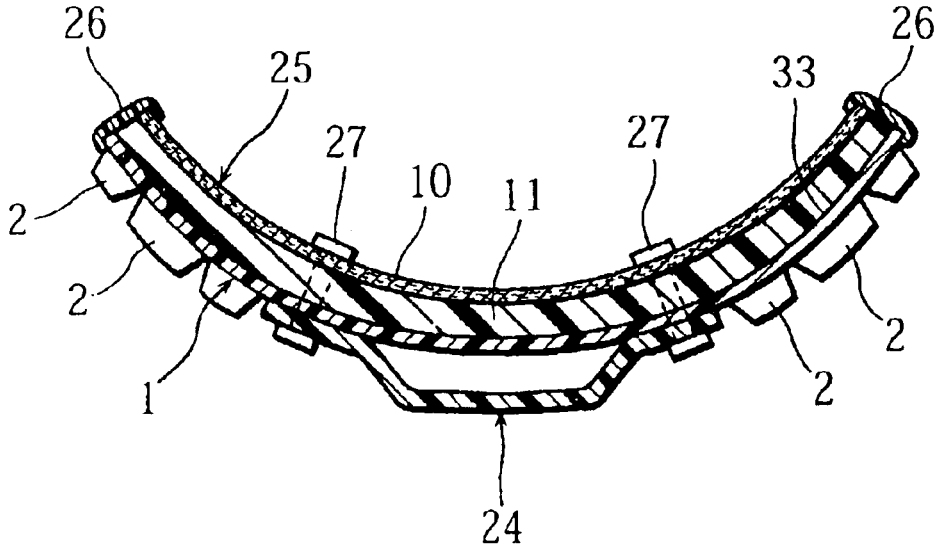
FIG. 4 is a lateral cross-sectional view showing another embodiment of the present invention.

Next, FIG. 4 shows a case that the reverse side of the cover 1 is preliminarily formed into a concave face corresponding to the leg by injection molding. That is to say, the pad portion 25 is R-shaped as to correspond to the leg (calf) and the protection board portion 24. The pad portion 25 is unitedly fixed to the protection board portion 24 by (caulking) pins 27 (or sewing).

Figure 5:
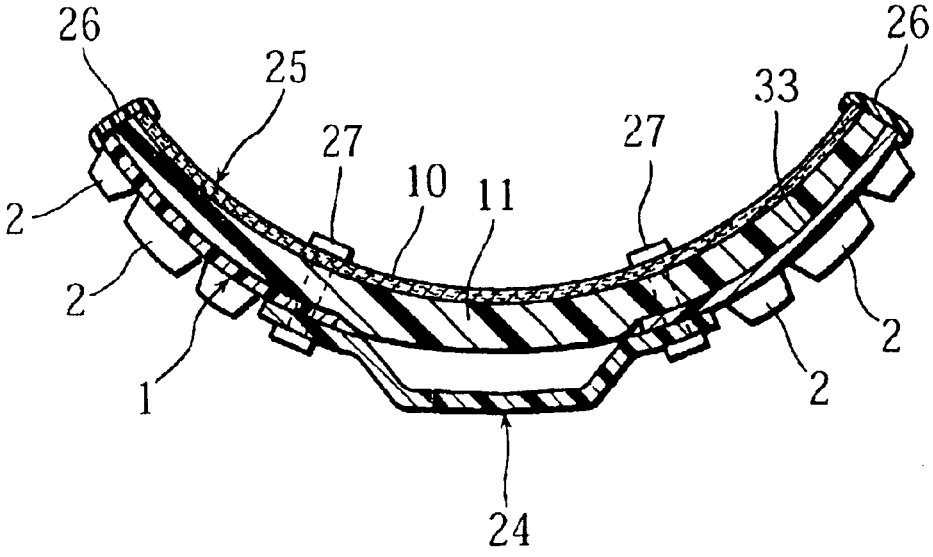
FIG. 5 is a lateral cross-sectional view showing still another embodiment of the present invention.

Next, FIG. 5 shows another embodiment of the pad portion 25 having the following construction clearly different in comparison with FIG. 4. That is to say, in FIG. 5, a part of the cover 1 covered by the protection board portion 24 on the surface side is omitted. To describe concretely, the cover 1 is composed as to be divided into two parts on the left and right sides of the protection board portion 24, or a hole portion is disposed on the part covered by the protection board portion 24. In short, the pad portion 25 has the injection-molded cover 1 of TPE at least on parts uncovered by the protection board portion 24.

Figure 6:
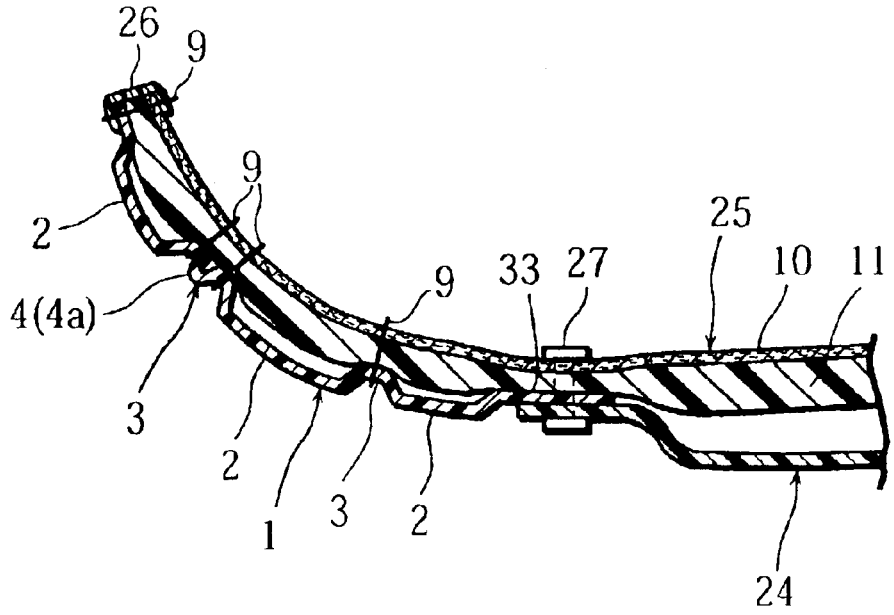
FIG. 6 is a lateral cross-sectional view showing a further embodiment of the present invention.
Figure 7A:
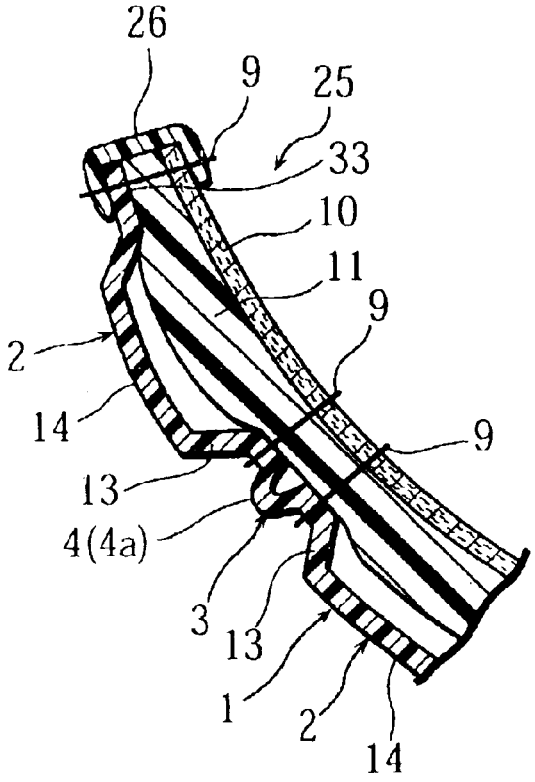
FIG. 7A is an explanatory enlarged cross-sectional view of a principal portion.

Next, FIG. 6 and FIG. 7A show still another embodiment of the pad portion 25 in which a bending promotion portion 4 in vertical direction is formed on the groove bottom 3 between the neighboring convex portion 2 (on left and right side edge portions of the cover 1).

The bending promotion portion 4 is composed of a convex small bent portion (small protruding bend 4*a*) on the face side, and two lines of the machine sewing thread 9 for sewing the lining 10 are disposed as not to interfere the bending promotion portion 4.

Figure 7B:
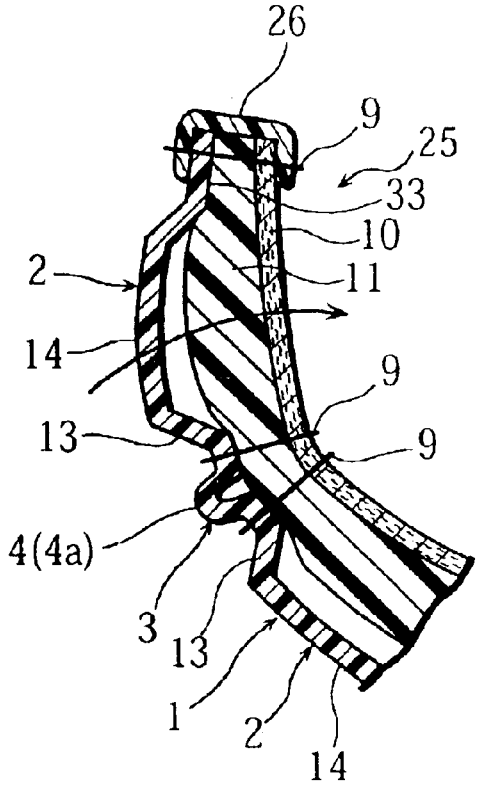
FIG. 7B is an explanatory enlarged cross-sectional view of the principal portion.

The small protruding bend 4*a* is, as shown in FIG. 7B, composed as to facilitate the bend of the cover 1 in a diminishing direction of the small protruding bend 4*a*. That is to say, the cover 1 is freely bent (elastically deformed) as to be convex to the face side in a direction to enlarge the groove portion. In other words, the cover 1 is hardly deformed in the opposite direction of FIG. 7B as to diminish the groove portion because the small protruding bend 4*a* interferes the peripheral wall portions 13.

And, when the leg guard is put on the leg, as shown in FIG. 7B, left and right side edge portions are easily bent as to be convex to the face side and corresponding to the contour of the leg (calf) to certainly cover the sides of the calf. To describe concretely, a thick calf is covered by the (preliminarily formed) R shape of the cover 1, and a slender calf can be covered by the R shape of the cover 1 and the bends on the left and right edge portions of the pad portion 25. Therefore, the shock of the spike shoes toward the leg (calf) in blocking of tag is alleviated, fitting feeling is enhanced, and injury can be prevented.

The configuration of the bending promotion portion 4 may be a small protrusion of which cross section is triangle, a configuration composed of plural small bends serially disposed, or any configuration which promotes the bend of the cover 1.

Figure 8:
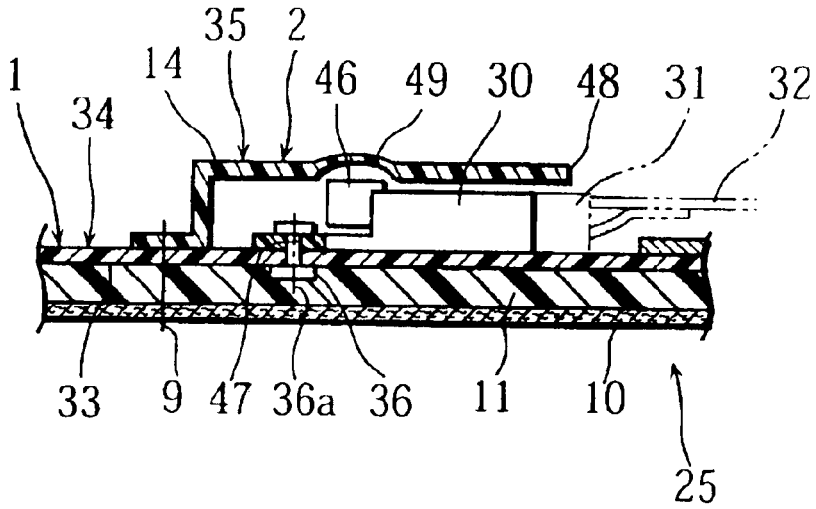
FIG. 8 is an enlarged cross-sectional view showing an attached state of a buckle female member.

And, the cover 1 has, as shown in FIG. 1 and FIG. 8, a block construction composed of a base cover 34 occupying most of the pad portion 25 and an attached cover 35 attached later to the base cover 34 (by sewing).

A buckle male member 31 is attached to an end portion of the belt 32, and a buckle female member 30, detachably hitching on the buckle male member 31, is attached to the pad portion 25 side.

The buckle female member 30 is attached to the cover 1 as to be on an inner side to an border line L of the pad portion 25 and covered by the convex portion 2.

To describe concretely, the buckle female member 30 is attached to the reverse wall portion 33 of the base cover 34 with a shaft member 36 (such as a caulking pin) as to freely oscillate around an axis 36*a* of the shaft member 36. And, the buckle female member 30 is covered by the convex portion 2 of the attached cover 35.

Figure 9:
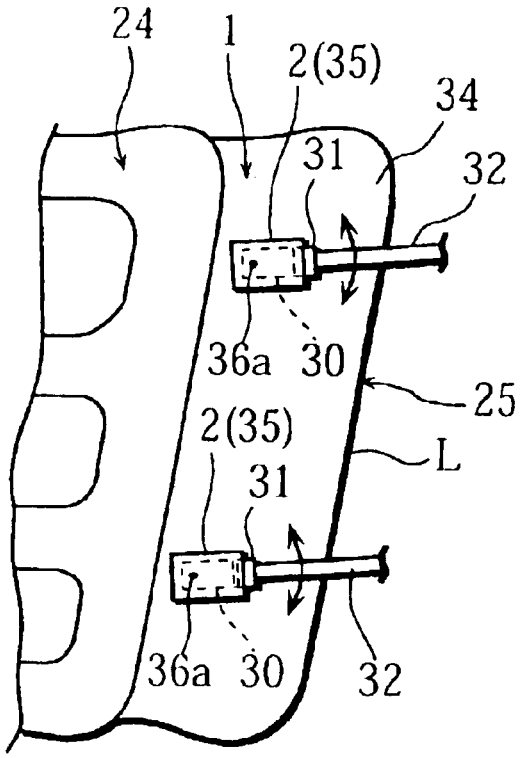
FIG. 9 is an explanatory front view of a principal portion.

Therefore, as shown in FIG. 9, the buckle female member 30 does not contact the leg and does not cause strange feelings when the leg guard is put on the leg in use, and the buckle female member 30 is prevented from breaking by stopping a ball or spike shoes of a sliding runner to contact the buckle female member 30 because the buckle female member 30 is disposed on the inner side to the border line L of the pad portion 25, covered by the convex portion 2, and oscillatable around the axis 36*a*. Further, the belt 32 wound around the leg causes no strange feeling, and the buckle female member 30 is hardly broken without excessive bending force working on parts of the buckle female member 30 because the buckle female member 30 freely changes its direction on the pad portion 25 side.

Further, in a hitching state in which a hitching claw portion 40 (refer to FIG. 10) of the buckle male member 31 is hitched to the buckle female member 30, the buckle male member 31 (especially, the hitching claw portion 40) can be prevented from breaking because the buckle male member 31 is positioned on an inner side to the border line L and the hitching claw portion 40 of the buckle male member 31 is covered by the convex portion 2 along with the buckle female member 30. And, the buckle male member 31 is hardly broken without excessive bending force working on the buckle male member 31 because the buckle male member 31 can change its direction along with the buckle female member 30.

Figure 10:
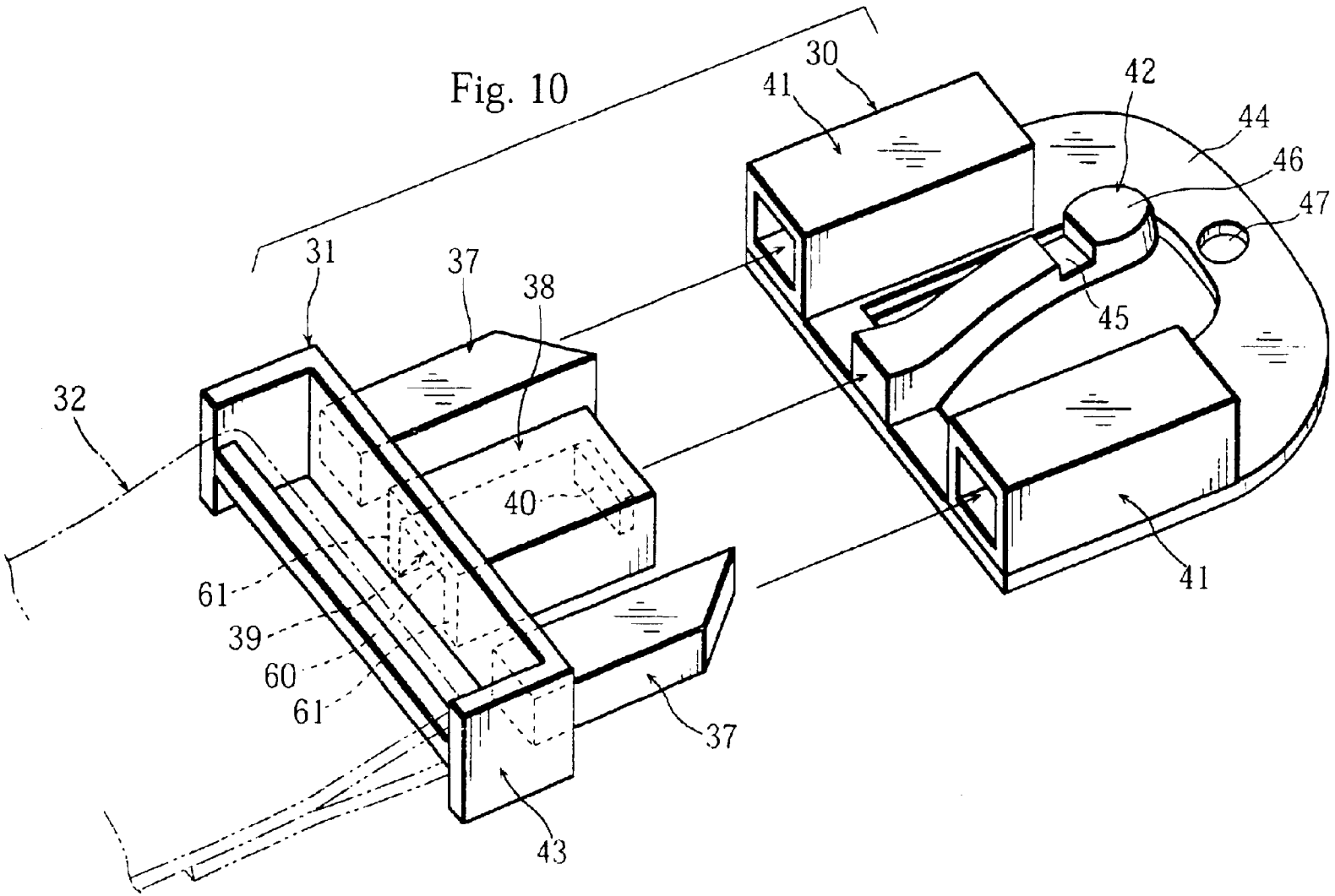
FIG. 10 is a perspective view showing buckle male and female members.

Next, as shown in FIG. 10, the buckle male member 31 has two guiding leg portions 37, a hitching leg portion 38 disposed between the two guiding leg portions 37, and a belt attachment portion 43 to which the belt 32 is attached, and the two guiding leg portions 37 and the hitching leg portion 38 are fixed.

The hitching leg portion 38 has a configuration opening toward a forth end side and having at least an upper wall portion 60 and left and right side wall portions 61. To describe concretely, the hitching leg portion 38 has a concave groove portion 39 opening downward (to the reverse side), and the hitching claw portion 40 is disposed on the concave groove portion 39 as to protrude downward (to the reverse side). That is to say, the hitching claw portion 40 is prevented from breaking because the hitching claw portion 40 is hidden inside the hitching leg portion 38.

The buckle female member 30 has guiding cylinder portions 41 to which the guiding leg portions 37 of the buckle male member 31 are inserted, an elastically-deformable hitching portion 42 fitted into the concave groove portion 39 in the hitching leg portion of the buckle male member 31, and a base portion 44 to which an end of the elastically-deformable hitching portion 42 and the guiding cylinder portions 41 are fixed.

A hitching concave portion 45, hitched by the hitching claw portion 40 of the hitching leg portion 38, and a pressed portion 46 to oscillate the elastically-deformable hitching portion 42 in vertical direction (as to be bent), are disposed on the other end of the elastically-deformable hitching portion 42. And, a hole portion 47, to which the shaft portion 36 (refer to FIG. 8) is inserted, penetrates the base portion 44.

Figure 11A:
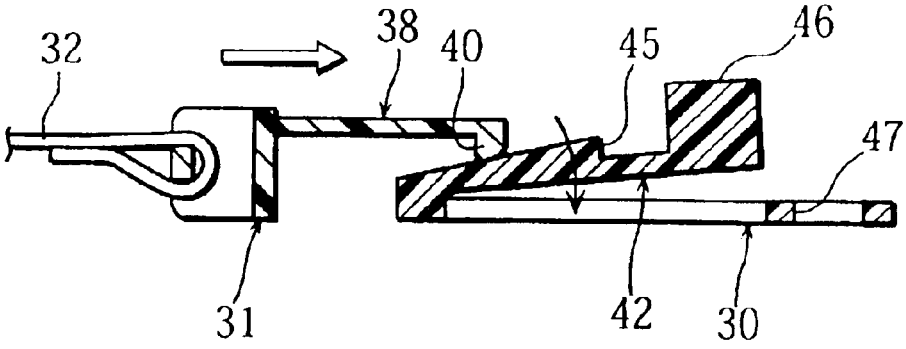
FIG. 11A is an explanatory cross-sectional view of a principal portion.
Figure 11B:
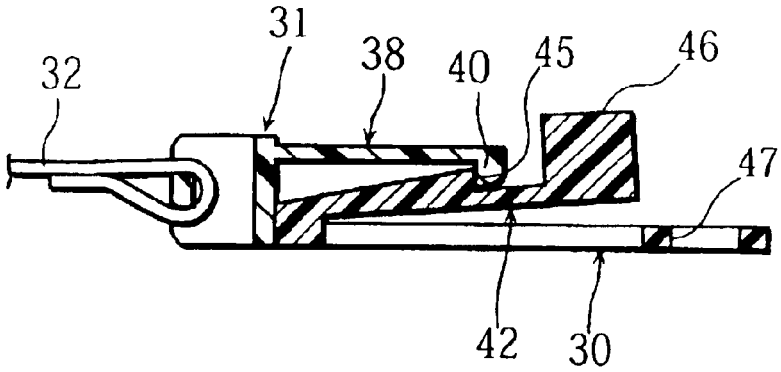
FIG. 11B is an explanatory cross-sectional view of the principal portion.
Figure 11C:
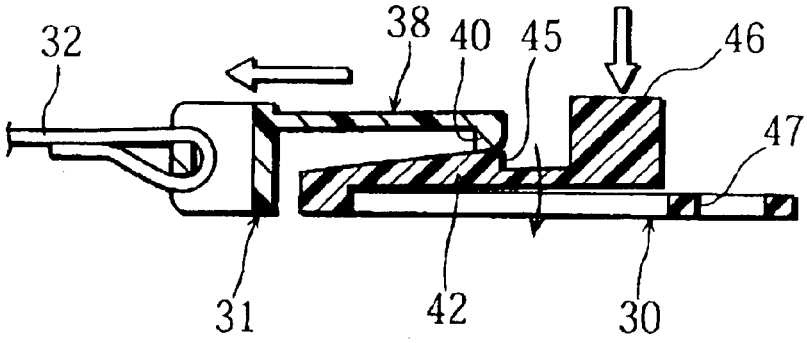
FIG. 11C is an explanatory cross-sectional view of the principal portion.

Next, hitching of the buckle male member 31 to the buckle female member 30 is described. As shown in FIG. 10, while the guiding leg portions 37 of the buckle male member 31 are inserted to the guiding cylinder portions 41 of the buckle female member 30 and the hitching leg portion 38 of the buckle male member 31 is fitted to the elastically-deformable hitching portion 42 of the buckle female member 30, the hitching claw portion 40 of the buckle male member 31 presses and oscillates the elastically-deformable hitching portion 42 of the buckle female member 30 downward as shown in FIG. 11A, and the buckle male member 31 is hitched on the buckle female member 30 by the hitching claw portion 40 fitting to the hitching concave portion 45 as shown in FIG. 11B. To describe release of the buckle male member 31 from the buckle female member 30, as shown in FIG. 11C, the buckle male member 31 can be released from the buckle female member 30 by pulling off the buckle male member 31 while the pressed portion 46 is pressed downward to oscillate the elastically-deformable hitching portion 42 downward.

Figure 12:
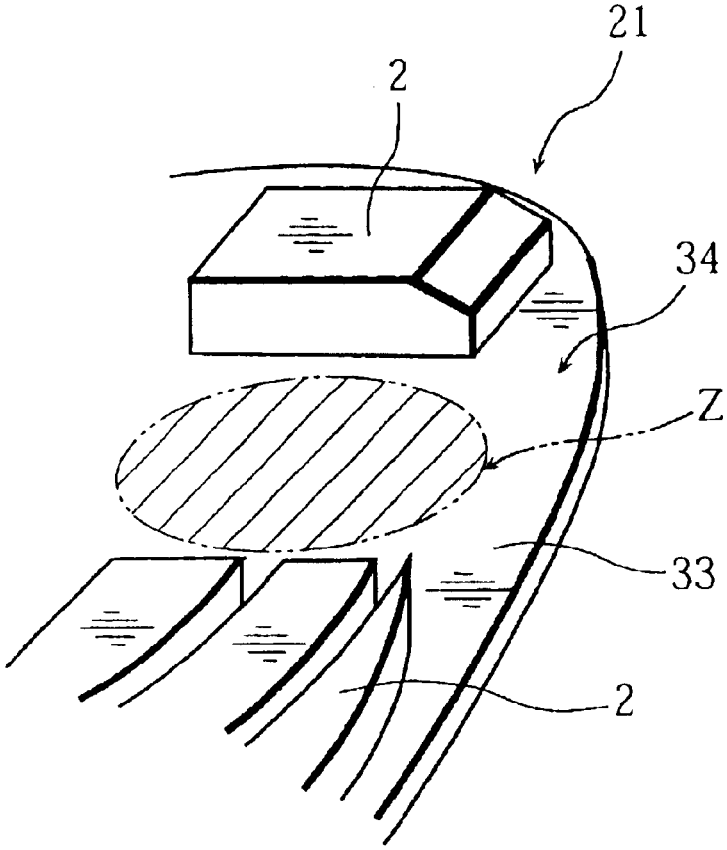
FIG. 12 is an enlarged perspective view of a principal portion.

Next, to describe the attachment of the buckle female member 30 to the pad portion 25 on the shin portion 21, first, as shown in FIG. 12, the base cover 34 is formed as to have a flat attachment area Z to which the buckle female member 30 is attached, and the attached cover 35 is formed as to have the convex portion 2 having a notched portion 48 for escapement of the buckle.

And, as shown in FIG. 8, the buckle female member 30 is attached on the reverse wall portion 33 (the attachment area Z) of the base cover 34 with the shaft member 36, and the attached cover 35 is placed on the base cover 34 as to cover the buckle female member 30 with the convex portion 2 from the surface side, then, the buckle female member 30 is attached to the pad portion 25 by sewing the attached cover 35, the base cover 34, the foamed body 11, and the lining 10 as to be united with the machine sewing thread 9.

Figure 13:
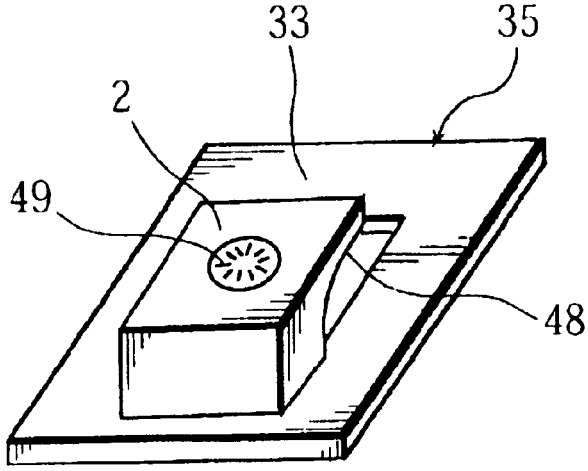
FIG. 13 is a perspective view of a principal portion.

As shown in FIG. 8 and FIG. 13, the pressed portion 46 can be pressed by pressing an elastically-deformable small convex portion 49 having thin wall, disposed on a part of the convex portion 2 (the surface wall portion 14) of the attached cover 35 facing the pressed portion 46 of the buckle female member 30, from the outside. The buckle male member 31 can be inserted to the buckle female member 30 through the notched portion 48 of the attached cover 35, and the notched portion 48 does not interfere the oscillation of the buckle female member 30.

Although not shown in Figures, the buckle female member 30 may be covered by another lid member (of polyacetal, etc.).

Figure 14:
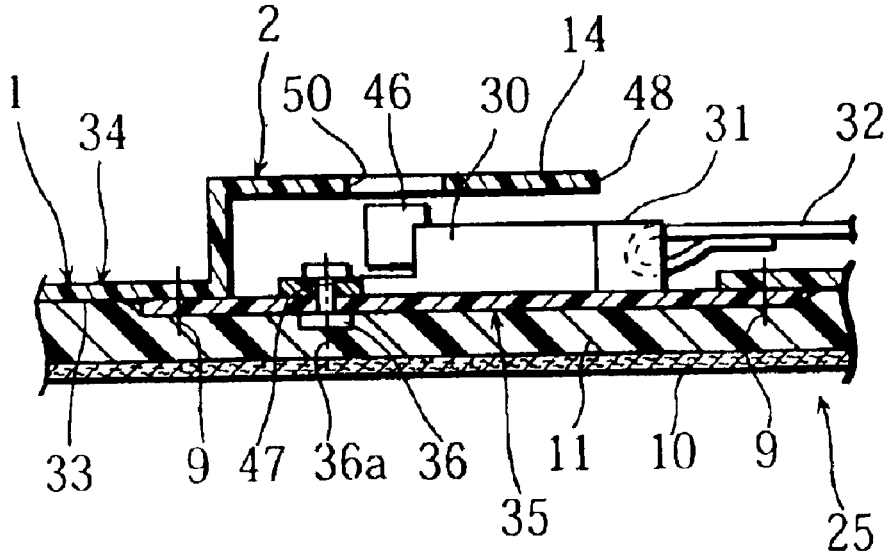
FIG. 14 is a cross-sectional view showing another embodiment of the attached state.

Next, another attached state of the buckle female member 30 to the pad portion 25 is shown in FIG. 14. After the buckle female member 30 is attached to the attached cover 35 with the shaft member 36, the buckle female member 30 is disposed within the convex portion 2 on the reverse side of the base cover 34, and the buckle female member 30 is attached to the pad portion 25 by sewing the attached cover 35 onto the reverse side of the base cover 34 with the machine sewing thread 9.

An operational hole portion 50 penetrates a position on the convex portion 2 (the surface wall portion 14) of the base cover 34 facing the pressed portion 46 of the buckle female member 30 to push the pressed portion 46 from outside. And, a notched portion 48 for escapement of the buckle is disposed on the convex portion 2 of the base cover 34.

Figure 15:
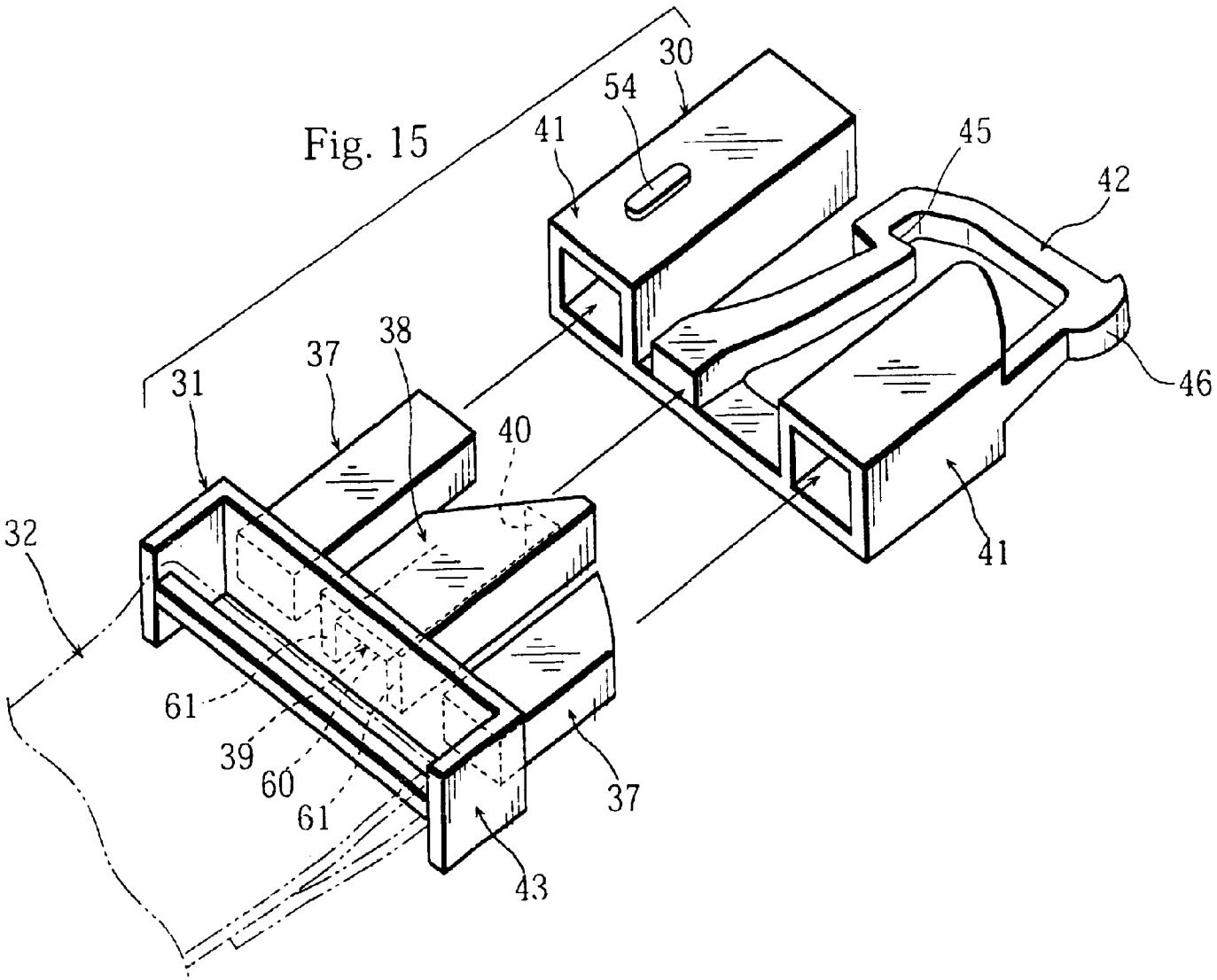
FIG. 15 is a perspective view showing another embodiment of the buckle male and female members.

Next, another embodiment of the buckle female member 30 and the buckle male member 31 is shown in FIG. 15. The following construction is clearly different in comparison with FIG. 10. That is to say, although the hitching claw portion 40 and the hitching concave portion 45 are hitched and released in up-and-down directions (vertical directions) in FIG. 10, the hitching claw portion 40 and the hitching concave portion 45 are hitched and released in left-and-right directions (horizontal directions) in FIG. 15. To describe concretely, the hitching claw portion 40 is disposed in the concave groove 39 of the hitching leg portion 38 as to laterally protrude, the hitching concave portion 45 is formed concave in lateral direction on the elastically-deformable hitching portion 42, and the pressed portion 46 is constructed as to oscillate the elastically-deformable hitching portion 42 in horizontal direction (as to be bent). The both end portions of the elastically-deformable hitching portion 42 are fixed.

Figure 16A:
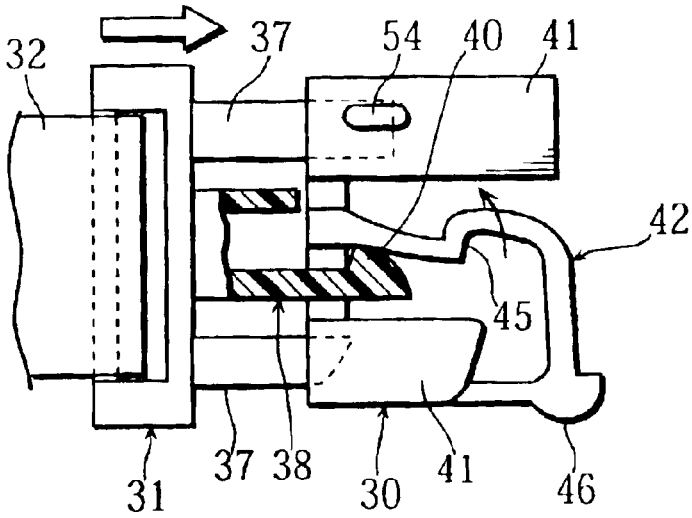
FIG. 16A is an explanatory top view of a principal portion.
Figure 16B:
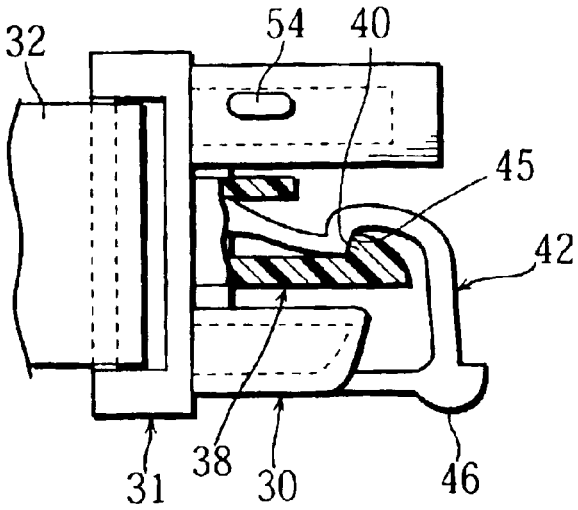
FIG. 16B is an explanatory top view of the principal portion.
Figure 16C:
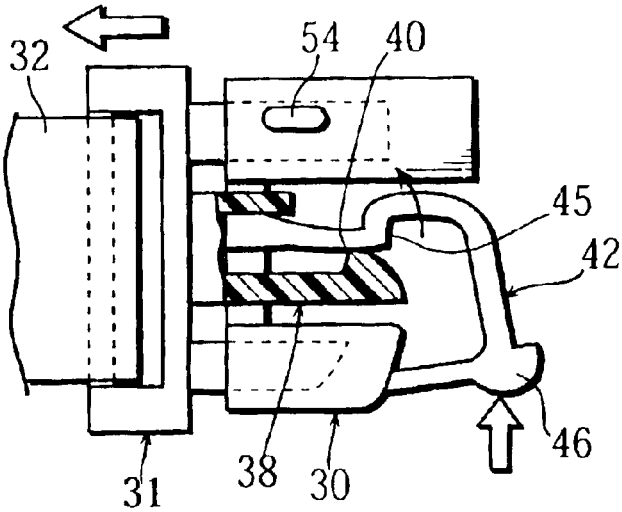
FIG. 16C is an explanatory top view of the principal portion.

And, hitching of the buckle male member 31 to the buckle female member 30 is described. As shown in FIG. 16A, while the guiding leg portions 37 of the buckle male member 31 are inserted to the guiding cylinder portions 41 of the buckle female member 30 and the hitching leg portion 38 of the buckle male member 31 is fitted to the elastically-deformable hitching portion 42 of the buckle female member 30, the hitching claw portion 40 of the buckle male member 31 presses and oscillates the elastically-deformable hitching portion 42 of the buckle female member 30 in lateral direction, and the buckle male member 31 is hitched on the buckle female member 30 by the hitching claw portion 40 fitting to the hitching concave portion 45 as shown in FIG. 16B. On the other hand, as shown in FIG. 16C, the buckle male member 31 can be released from the buckle female member 30 by pulling off the buckle male member 31 while the pressed portion 46 is pressed in lateral direction to oscillate the elastically-deformable hitching portion 42 in lateral direction.

Figure 17:
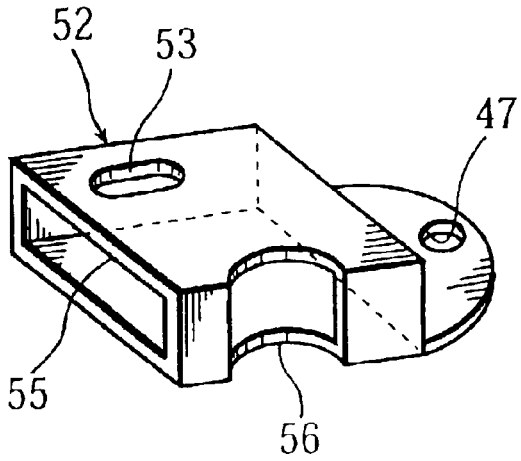
FIG. 17 is a perspective view showing an oscillation cover member.
Figure 18:
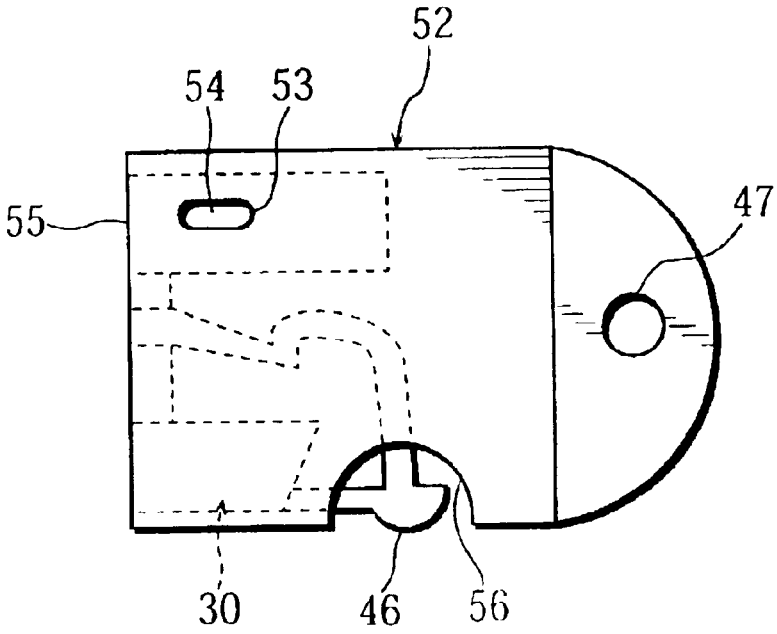
FIG. 18 is a top view of the oscillation cover member.

And, buckle female member 30 shown in FIG. 15 is covered by an oscillation cover member 52 shown in FIG. 17 for reinforcement. That is to say, as shown in FIG. 17 and FIG. 18, the oscillation cover member 52 is a hollow body in which an opening portion 55 for insertion of the buckle female member 30, a positioning hole 53 to which a positioning protrusion 54 of the buckle female member 30 is fitted, a notched portion 56 to expose the pressed portion 46 of the buckle female member 30, and a hole portion 47 for insertion of the shaft member 36 (refer to FIG. 8), are formed.

Figure 19:
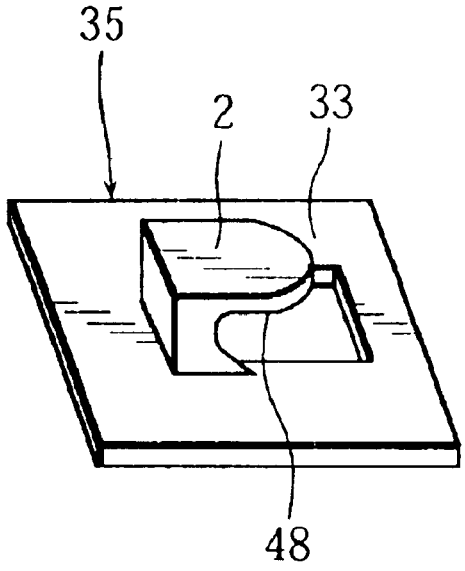
FIG. 19 is a perspective view of a principal portion.

Next, to describe attachment of the oscillation cover member 52 including the buckle female member 30 to the pad portion 25, first, as shown in FIG. 12, the base cover 34 is formed as to have the flat attachment area Z to which the buckle female member 30 is attached, and the attached cover 35 is formed as to have the convex portion 2 having a notched portion 48 for escapement of the buckle as shown in FIG. 19.

Figure 20:
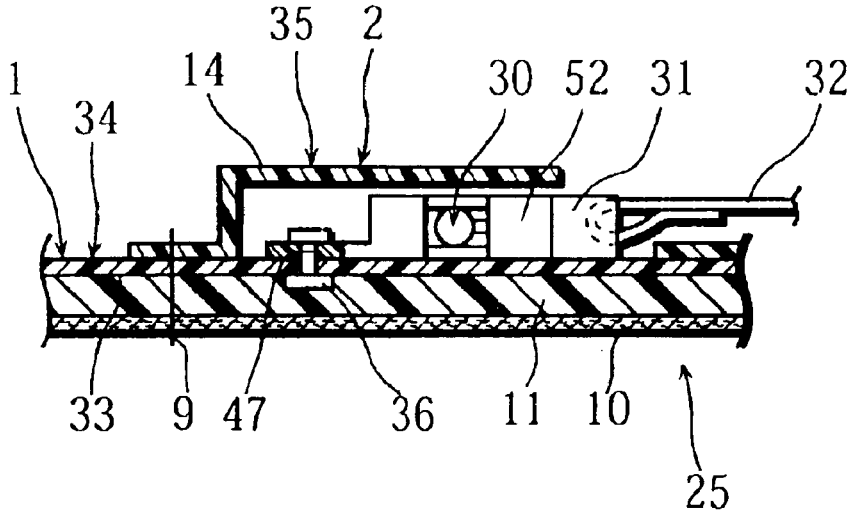
FIG. 20 is a cross-sectional view showing still another embodiment of the attached state.

And, as shown in FIG. 20, the oscillation cover member 52 including the buckle female member 30 is attached on the base cover 34 with the shaft member 36, and the attached cover 35 is placed on the base cover 34 as to cover the oscillation cover member 52 with the convex portion 2 from the surface side, then, the oscillation cover member 52 is attached to the pad portion 25 by sewing the attached cover 35, the base cover 34, the foamed body 11, and the lining 10 as to be united with the machine sewing thread 9.

Figure 21:
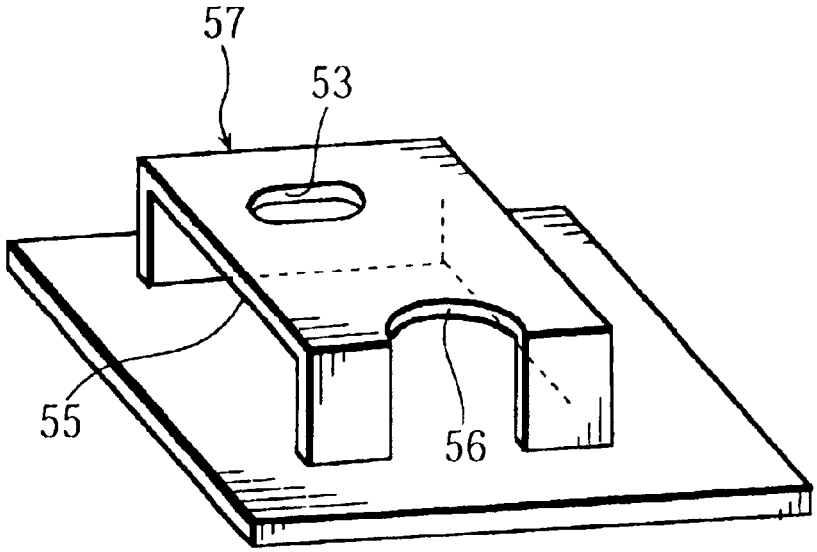
FIG. 21 is a perspective view showing a fixation cover member.
Figure 22:
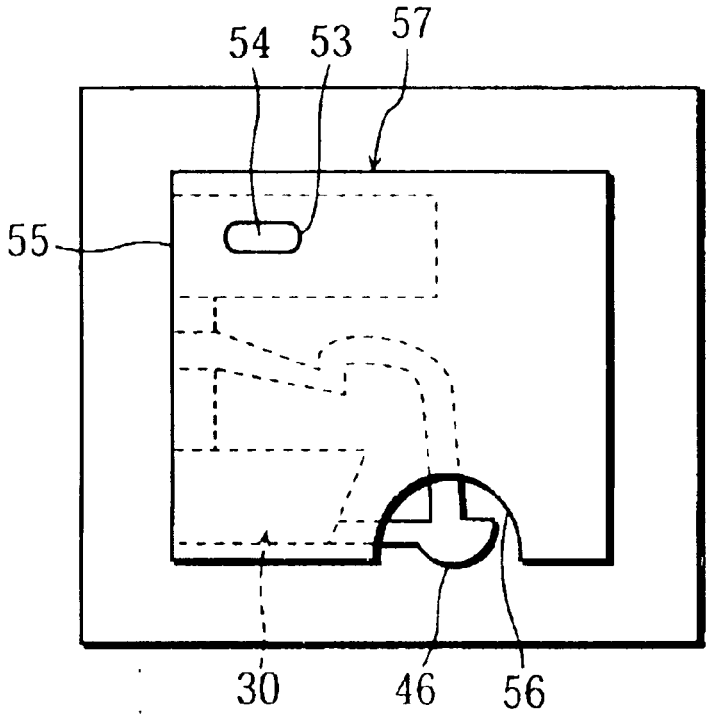
FIG. 22 is a top view of the fixation cover member.

The buckle female member 30 shown in FIG. 15 may be covered by a fixation cover member 57 shown in FIG. 21 instead of the oscillation cover member 52 above. That is to say, as shown in FIG. 21 and FIG. 22, the fixation cover member 57 is a through body in which an opening 55 for insertion of the buckle female member 30, a positioning hole 53 to which a positioning protrusion 54 of the buckle female member 30 is fitted, and a notched portion 56 to expose the pressed portion 46 of the buckle female member 30, are formed.

Figure 23:
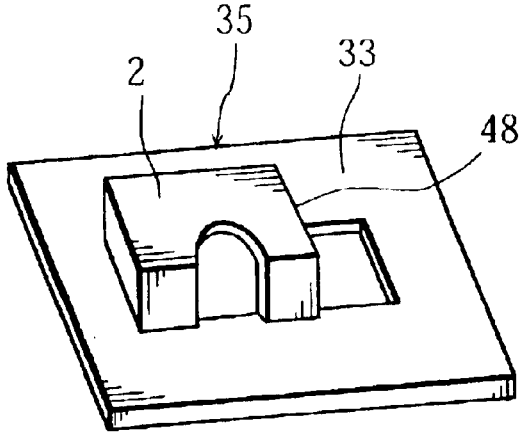
FIG. 23 is a perspective view of a principal portion.

Next, to describe attachment of the fixation cover member 57 including the buckle female member 30 to the pad portion 25, first, as shown in FIG. 12, the base cover 34 is formed as to have the flat attachment area Z to which the buckle female member 30 is attached, and the attached cover 35 is formed as to have the convex portion 2 having a notched portion 48 for escapement of the buckle as shown in FIG. 23. The notched portion 48 of the attached cover 35 is sized only to insert the buckle male member 31 to prevent the fixation cover member 57 (the buckle female member 30) from oscillation.

Figure 24:
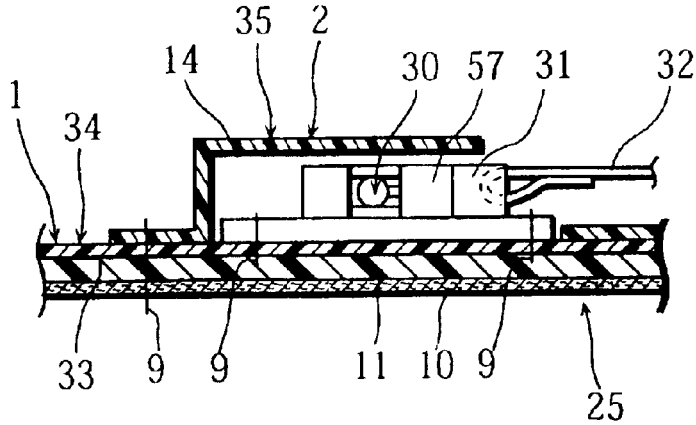
FIG. 24 is a cross-sectional view showing a further embodiment of the attached state.

And, as shown in FIG. 24, the fixation cover member 57 including the buckle female member 30 is sewn on the base cover 34 with the machine sewing thread 9, and the attached cover 35 is placed on the base cover 34 as to cover the fixation cover member 57 with the convex portion 2 from the surface side, then, the fixation cover member 57 is attached to the pad portion 25 by sewing the attached cover 35, the base cover 34, the foamed body 11, and the lining 10 as to be united with the machine sewing thread 9.

Figure 25:
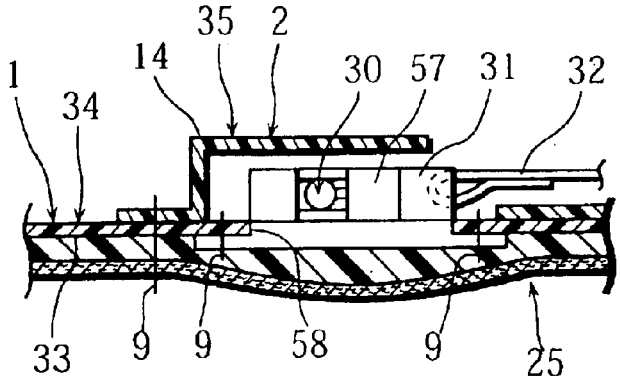
FIG. 25 is a cross-sectional view showing another embodiment of the attached state.

As shown in FIG. 25, a window portion 58 may be formed on the base cover 34 to insert the fixation cover member 57 from the reverse side of the base cover 34 to be sewn to the base cover 34.

Figure 26:
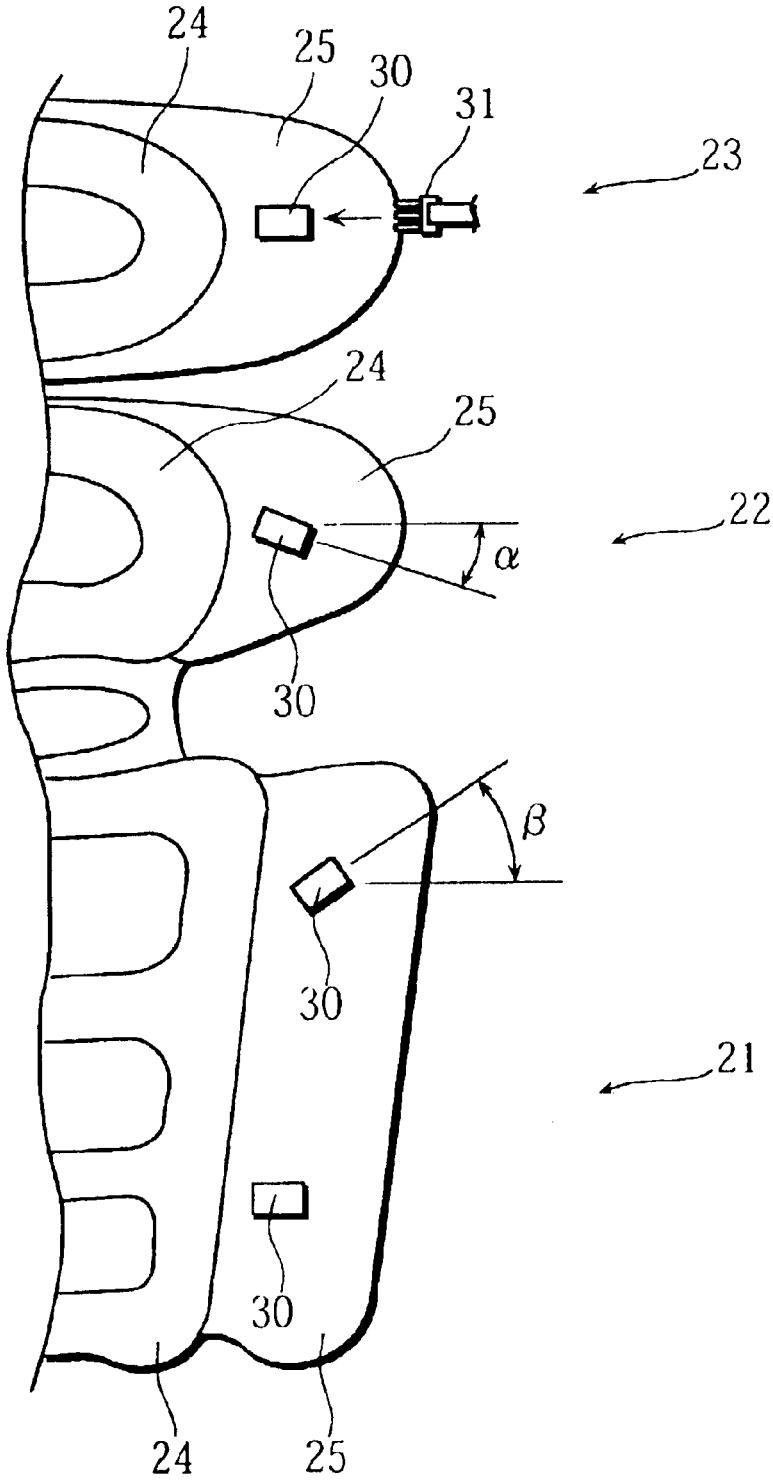
FIG. 26 is a front view showing positioning directions of the buckle female members.

FIG. 26 shows a case that the buckle female member 30 is fixedly attached to the pad portion 25. The buckle female member 30 on the sub-knee portion 23 is disposed as the insertion direction of the buckle male member 31 is horizontal. The buckle female member 30 on the knee portion 22 is disposed as the insertion direction of the buckle male member 31 is a declining angle $\alpha$ direction (20° to 60°) to the horizon. The buckle female member 30 on the shin portion 21 disposed as the insertion direction of the buckle male member 31 is an inclining angles $\beta$ direction (20° to 60°) to the horizon, and the buckle female member 30 on a lower part of the shin portion 21 is disposed as the insertion direction of the buckle male member 31 is horizontal. Therefore, the buckle female member 30 and the buckle male member 31 are hardly broken because excessive bending force does not work when the buckle male member 31 is hitched to the buckle female member 30.

Figure 27:
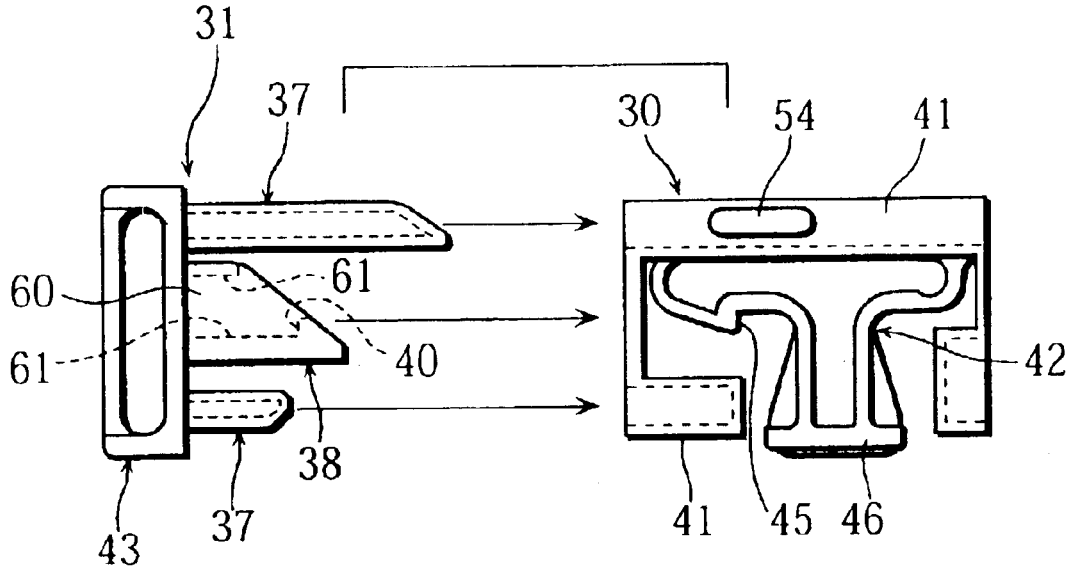
FIG. 27 is a perspective view showing still another embodiment of the buckle male and female members.

Next, FIG. 27 shows another embodiment of the buckle female member 30. The following construction is clearly different in comparison with FIG. 15. That is to say, while the buckle female member 30 in FIG. 15 bends the elastically-deformable hitching portion 42 by pushing in a direction parallel to the fixation direction of the both ends of the elastically-deformable hitching portion 42, the buckle female member 30 in FIG. 27 bends the elastically-deformable hitching portion 42 by pushing in the fixation direction of the both ends of the elastically-deformable hitching portion 42, so stress by the bend on the fixation portion of the both ends of the elastically-deformable hitching portion 42 can be reduced.

Figure 28:
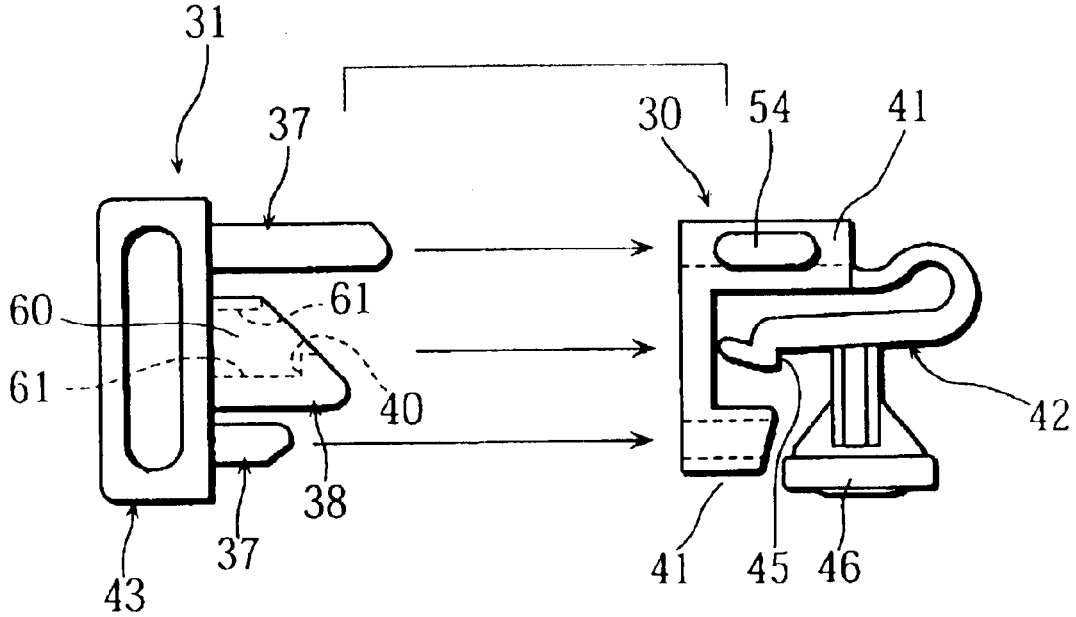
FIG. 28 is a perspective view showing a further embodiment of the buckle male and female members.

Next, FIG. 28 shows still another embodiment of the buckle female member 30. The following construct ion is clearly different in comparison with FIG. 27. That is to say, while the both ends of the elastically-deformable hitching portion 42 are fixed in the buckle female member 30 in FIG. 27, one end of the elastically-deformable hitching portion 42 on the hitching concave portion 45 is an free end in FIG. 28, so the elastically-deformable hitching portion 42 can be easily bent.

Figure 29:
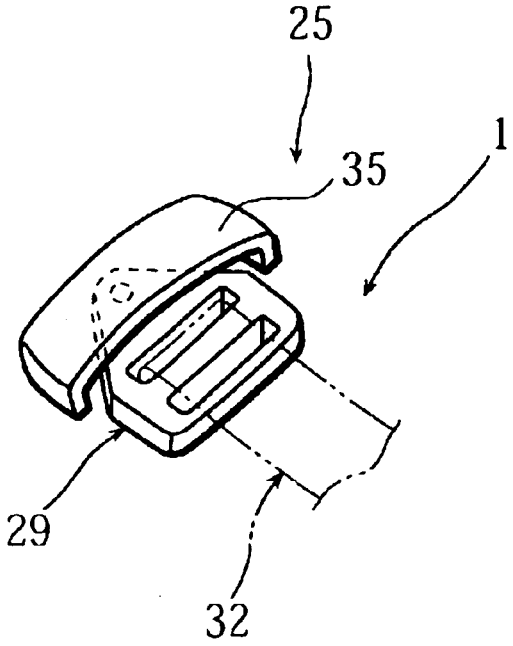
FIG. 29 is a perspective view showing an attached state of a belt attachment member.

Next, as shown in FIG. 29, the belt 32 (refer to FIG. 1) is attached to the main body of the leg guard, and (at least) a part of the belt attachment member 29 to regulate the length of the belt 32 is covered by the attached cover 35.

Figure 30:
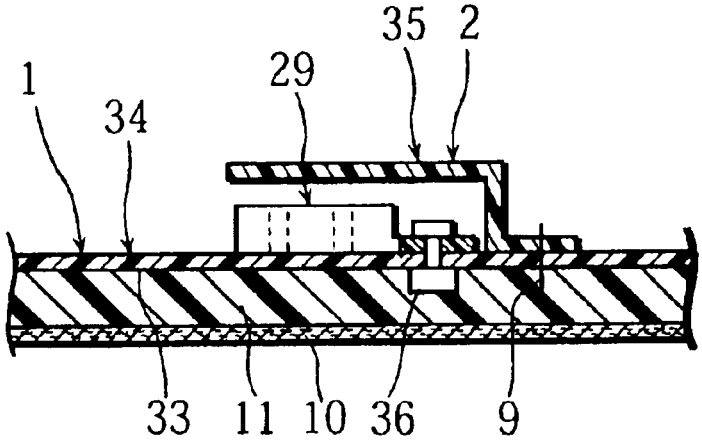
FIG. 30 is a cross-sectional view showing another attached state of the belt attachment member.

And, as shown in FIG. 30, the belt attachment member 29 may be attached to the base cover 34 with the shaft member 36 and covered by the attached cover 35. The belt attachment member 29 can be certainly protected and oscillatable as to follow the movement of the leg.

Although not shown in Figures, the surface of the cover 1 (namely, the surface wall portion 14 of the convex portion 2) may be formed preliminarily into a curved face, a concavo-convex face, or an inclined face. And, the surface of the cover may be formed preliminarily into a leather-grain pattern. In short, these configurations and patterns can be easily formed on the cover 1 by forming an injection mold into these configurations and patterns.

And, at least one pad portion 25, of the pad portions 25 on the instep portion 20, the knee portion 22, and the sub-knee portion 23, may be constructed similar to the pad portion 25 of the shin portion 21 described above.

And, although each of the pad portions 25 of the leg guard shown in FIG. 1 is allotted to each of the parts (the instep portion 20, the shin portion 21, the knee portion 22, and the sub-knee portion 23), the pad portions 25 may be unitedly formed into one body (one sheet).

In the present invention, which is not restricted to the embodiments described above, for example, the lining 10 may be composed of injection-molded thermoplastic elastomer, the hitching leg portion 38 of the buckle male member 31 may be cylindrical, and the design of the leg guard may be changed within the scope of the present invention.

According to the leg guard of the present invention, degree of freedom of the design of the cover 1 is enhanced to easily form desired surface configurations and patterns. And, dimensions such as the thickness of the cover 1 can be freely changed to improve shock absorbability (cushion). And, the cover 1 can be prevented from breaking by spike shoes in sliding or friction with the ground. And, the shock resistance against balls and spike shoes is improved by the convex portion 2.

Further, the leg guard can be used without strange feelings because the buckle female members 30 and the buckle male members 31 do not touch the leg when the leg guard is put on the leg. And, the buckle female members 30 and the buckle male members 31 can be prevented from breaking by stopping balls and spike shoes of sliding runners against the buckle female members 30 and the buckle male members 31.

And, the belt 32 wound around the leg does not cause strange feelings, and parts such as the buckle female members 30 and the buckle male members 31 are hardly broken without excessive bending force because the directions of the buckle female members 30 can be freely changed on the pad portion 25 side.

The hitching claw portion 40 can be certainly prevented from breaking. And, the cover 1, giving the leg feeling of fitting, can be formed easily and certainly.

And, the sides of the leg can be covered and the leg is certainly protected because bendability (flexibility) is improved by the bending promotion portion 4. And, the convex portion 2, the groove bottom 3, and the bending promotion portion 4 can be unitedly formed by injection molding to facilitate the forming and shorten the forming time. And, these parts give the leg feeling of fitting because the leg guard easily bends along with the leg.

And, the leg guard can be certainly sewn with the machine sewing thread 9 to make the leg guard strong, excellent in durability, and bendable smoothly as a whole.

And, the leg guard can be easily mass-produced by forming a mold as to have configurations and patterns of the surface wall portion 14. And, leg guards of various designs, hardly expected in conventional leg guards, can be easily made.

Further, the leg guard can express a luxurious touch with the cover 1 of which surface appears to be made of leather or synthetic (artificial) leather.

While preferred embodiments of the present invention have been described in this specification, it is to be understood that the invention is illustrative and not restrictive, because various changes are possible within the spirit and indispensable features.

What is claimed is:

1. A leg guard comprising:

a pad portion having a cover, composed of injection-molded thermoplastic elastomer and having plural convex portions protruding from a surface side;

a buckle female member attached to the cover so as to be disposed on an inner side to a border line of the pad portion and covered by the convex portion; and a buckle male member detachably hitching to the buckle female member and disposed on an inner side to the border line in a hitching state to the buckle female member.

2. The leg guard as set forth in claim 1, wherein the buckle female member is attached to the cover so as to freely oscillate.

3. The leg guard as set forth in claim 1 or claim 2, wherein the buckle male member is provided with a hitching leg portion of a configuration having at least an upper wall portion and left and right side wall portions and opening toward a forth end side, and a hitching claw portion detachably hitching to the buckle female member is hidden inside the hitching leg portion.

4. The leg guard as set forth in claim 1 or 2, wherein a reverse side of the cover is preliminarily formed into a concave curved face corresponding to a leg.

5. The leg guard as set forth in claim 1 or 2, wherein a bending promotion portion is formed on a groove bottom between neighboring convex portions.

6. The leg guard as set forth in claim 5, wherein the bending promotion portion is composed of a small protruding bend convex on a face side, and the cover can be freely bent to be convex on the face side.

7. The leg guard as set forth in claim 6, wherein two lines of machine sewing thread sewn on a lining are disposed on both sides of the small protruding bend convex.

8. The leg guard as set forth in claim 1 or 2, wherein a surface wall portion of the convex portion of the cover is formed into a curved face, a concavo-convex face, or an inclined face.

9. The leg guard as set forth in claim 1 or 2, wherein the surface of the cover is preliminarily formed into a leather-grain pattern.

10. A leg guard comprising a pad portion having a cover, composed of injection-molded thermoplastic elastomer and having plural convex portions protruding from a surface side, wherein a bending promotion portion is formed on a groove bottom between neighboring convex portions, the bending promotion portion is composed of a small protruding bend convex on a face side, and the cover can be freely bent to be convex on the face side, and two lines of machine sewing thread sewn on a lining are disposed on both sides of the small protruding bend convex.

11. A leg guard comprising a pad portion having a cover, composed of injection-molded thermoplastic elastomer and having plural convex portions protruding from a surface side, wherein a bending promotion portion, composed of a small protruding bend convex on a face side, is formed on a groove bottom between neighboring convex portions, and the cover can be freely bent to be convex on the face side.

* * * * *